United States Patent [19]

Johnson et al.

[11] 3,994,102

[45] Nov. 30, 1976

[54] INFLATABLE ELEMENT AND SYSTEM

[75] Inventors: Alan C. Johnson; Richard C. Stange, both of Philadelphia, Pa.

[73] Assignee: Alley Friends, Philadelphia, Pa.

[22] Filed: Sept. 10, 1975

[21] Appl. No.: 612,260

Related U.S. Application Data

[63] Continuation of Ser. No. 466,980, May 6, 1974, abandoned.

[52] U.S. Cl. ..... 52/2; 46/87

[51] Int. Cl.[2] ..... E04B 1/345

[58] Field of Search ..... 46/87–90, 46/28; 52/2

[56] References Cited

UNITED STATES PATENTS

| | | | |
|---|---|---|---|
| 1,916,527 | 7/1933 | Pastir | 46/87 |
| 2,134,063 | 10/1938 | Turchangi | 46/87 |
| 2,591,829 | 4/1952 | Katzenmeyer | 52/2 |
| 2,952,094 | 9/1960 | Ebel | 46/90 |
| 2,959,888 | 11/1960 | Noble | 46/28 |
| 3,048,860 | 8/1962 | Richardson | 46/87 |
| 3,277,479 | 10/1966 | Struble | 52/2 |
| 3,550,311 | 12/1970 | Fouquart | 52/2 |
| 3,716,953 | 2/1973 | Moore | 52/2 |

FOREIGN PATENTS OR APPLICATIONS

| | | | |
|---|---|---|---|
| 1,523,414 | 3/1968 | France | 52/2 |
| 378,944 | 2/1940 | Italy | 52/2 |

*Primary Examiner*—Price C. Faw, Jr.
*Assistant Examiner*—Henry Raduazo
*Attorney, Agent, or Firm*—Paul Maleson; Morton J. Rosenberg

[57] ABSTRACT

An elongated inflated or inflatable element including closed loops at each end. The element has certain broad dimensional relationships between its loop measurements and other measurements, and is intended to be used in connection with a plurality of other elements to make joints and form structures. A system comprising a plurality of inflated elements having joint means and capable of being joined and assembled into a large variety of different structures. The joint means are inherent in the inflated structure of the elements.

6 Claims, 12 Drawing Figures

INFLATABLE ELEMENT AND SYSTEM

This is a continuation of application Ser. No. 466,980, filed May 6, 1974 and now abandoned.

BACKGROUND OF THE INVENTION

1. Field of the Invention

This invention relates to and is an object to provide an inflated or inflatable element. More particularly it relates to an inflated or inflatable element which is preferably cylindrical and is generally of circular cross section and is provided at each end with a closed loop having certain dimensional relationships. It also relates to and it is an object o to provide an inflated or inflatable element which is generally and substantially cylindrical throughout its length, and is elongated, and adapted to join to a looped element.

The invention also pertains to a set or plurality of inflated or inflatable elements all of which have joining means inherent in their inflated structure and which permit joining and assembly into a wide variety of useful structures.

Another object of this invention is to provide various joints between inflated structural elements.

Another object of this invention is to provide useful structures comprised of a plurality of inflated elements.

Other aims and objects of this invention are made apparent in the following specification and claims.

2. Prior Art

Many prior art uses are known of inflatable devices which are really ballons having relatively very thin walls. Such ballons are known to be capable of being fastened together by twisting one elongated balloon around another to form various shapes. It has been known to provide separate joining means of various types for inflated balloons, where the joining means are various types of sticks or snaps. It has been known to place inflatable baloons within each other to form decorative appearances.

It has been broadly known to provide ballon-like inflated structures with holes or openings formed directly into the inflated portion, as in the provision of a swimmer's inflated life ring, wherein the swimmer's head can extend through a hole in an inflated life ring, which in turn may form part of a larger inflated structure. It has been known to use inflated structural purposes, as in antenna supports and in making certain types of furniture as chairs and hassocks out of inflated ballon-like devices. It is believed however that none of the prior art suggest the specific elements as disclosed herein nor does it suggest the overall useful concept of this invention when considered in its context.

SUMMARY OF THE INVENTION

A looped inflated element. The element is elongated, and the central section is a main portion having a generally cylindrical shape along its long dimension and a generally circular or circular approaching transverse cross section. It is provided at each end with a closed loop, which is part of the same inflated non-compartmentalized structure as the main portion. Each closed loop encloses an opening therethrough. Preferably, the diameter of each opening is slightly less than the diameter of said transverse cross-section of the main portion, and the overall outer diameter of the closed loop is larger than the diameter of each opening.

Another element in the invention is a plain inflated element, which is elongated and has a generally cylindrical body with a circular or circular approaching transverse cross-section. The ends are sealed and the corners extend into small points. The diameter along the transverse cross section of the plain inflated element is preferably slightly larger than the diameter of the holes in the looped inflated elements. A shorter form of the plain inflated element is provided and is considered to be a plug joiner.

A basic joint is made by inserting the end of a plain inflated element through a hole in a looped inflated element. Another basic joint is made by forcing one loop through the hole in another loop. Various compound joints are possible.

A plurality of interconnectable elements of the type described above are provided. They may be assembled using the basic joints into a variety of more complex and compound structures. The structures may be open work or may include solid planes. The structures may be two dimensional or three dimensional. They may enclose volumes or may be generally planar in effect and function. The structures may be useful as toys, displays, decorative devices, or as architectural structures, such as cabins for example.

DESCRIPTION OF THE PREFERRED EMBODIMENTS

Broadly, this invention comtemplates a system suitable for easily constructing and easily disassembling relatively large scale structures. It involves the various basic elements that go into the structures and the means of interconnecting them to form certain fundamental structures.

Figure 1:
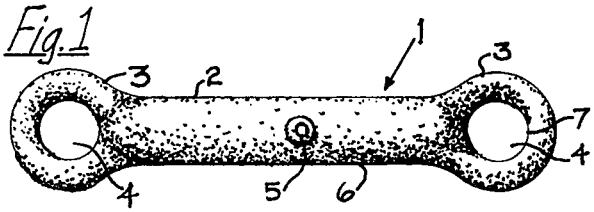
FIG. 1 is a plan view of a looped inflated element.
Figure 2:
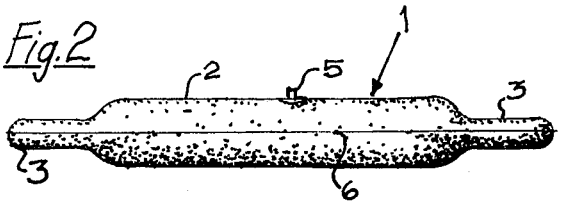
FIG. 2 is a side view of the looped inflated element as shown in FIG. 1.
Figure 3:
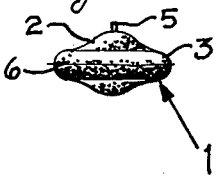
FIG. 3 is an end view, taken from the right hand side of the looped inflated element.

The most useful basic element or structure is best illustrated in FIGS. 1, 2 and 3. It is a looped inflatable element, generally designated 1. As illustrated, it is in its inflated condition. It is generally an elongated generally circular cross section element having closed loops at each end. The main portion 2 comprises the major proportion of the length of the inflated element 1. The main portion is generally of circular cross section and is cylindrical. At each end the main portion 2 terminates in a closed loop 3. The structure of each loop 3 encloses an opening 4.

As best seen in FIG. 1, looking at the element 1 in plan view, the outside diameter of each loop 3 is larger than the transverse diameter of the main portion 2. Several consequences flow from this dimensional relationship. One consequence is that the diameter of each opening 4 can be closely related in size to the transverse diameter of the main portion 2, which is important because it permits the openings 4 to receive main portions of other elements. Another consequence of the overall diameter of loop 3 being greater than the transverse diameter of main portion 2 is that when elements are in assembled relationship, the loops 3 also serves a locking or retaining function. The preferred dimensional relationships and further explanation of the functional interrelationships are explained in more detail below.

The closed loops themselves are of generally circular cross section generally substantially smaller than the cross section of the main portion 2. FIG. 2, a side view, best shows how the cross-section (or transverse diameter) of the closed loops 3 reduces from the cross section or transverse diameter of the main portion 2. As shown in FIG. 2, the reduction in diameter is preferrably gradual.

FIG. 3, an end view of the looped inflated element 1, best shows how the overall transverse dimension in a horizontal plane increases gradually from the main portion to the loop portion.

The element 1 is an inflatable structure made of an impermeable, flexible sheet material. It is provided with an inflation valve 5. A preferred form of constructing the element 1 is to die cut two identical flat pieces of the sheet material into a shape substantially identical or very similar to the outline best shown in FIG. 1. The valve 5 is installed in one of the pieces. Then, the two pieces are sealed together along their edges. The outer seal line around the entire element is designated 6. The seals around the insides of the loops 3, thus defining the extent of openings 4, are designated 7. The seal 6 may be called the outer seal, and the seals 7 may be called the inner seals.

The impermeable, flexible sheet material may be sheet plastic, and polyvinyl chloride is highly suitable. It may have a guage or thickness of 0.25–0.50 mm for example as one useful thickness. The seals 6 and 7 may preferrably be heat seals. The valve 5 may be any suitable valve capable of being opened for inflation or deflation, and being closed. A great many such valves for use on inflatable devices are very well known in the field. One type of suitable valve is known as a Roberts valve. It has a part which may be pulled away from the inflatable device with a pull tab, in which condition the valve is opened. It may be closed by pushing the part back in, and the part may be pushed in so as to be substantially flush with the surface of the inflatable device.

To indicate the context of this invention, two representative sets of dimensions or a looped inflated element 1 are given. In one size of element, the overall length of element 1 is 32 inches; the transverse diameter of the main portion 2 is 3½ inches. The overall largest transverse diameter of the entire loop 3 is 6¼ inches; the diameter of the opening 4 (or the internal diameter of the loop 3) is 3 inches; the diameter of the inflated part of the loop 3 itself (the transverse diameter of its cross-section) is 1⅝ inches. The dimensions are approximate. Another representative set of dimensions for looped inflated element 1 is a length of 4 feet; a transverse diameter of main portion 2 of 7½ inches; a diameter of the opening 4 of 7 inches; the transverse diameter of the cross section of the inflated portion of loop 3 itself of 2½ inches; the overall outside diameter of loop 3 of 13½ inches. All dimensions are approximate. The various inflated parts do not necessarily attain perfect circular cross sections nor is this necessary for the practice of the invention. It is a characteristic of inflated devices to tend toward such cross section within the limits of the structure.

If sheet PVC is used the material is relatively deformable and compliant. Wrinkles smooth out easily and there is a close approach to circular cross-sections, and the elements may be easily inflated by breath. The amount of structural rigidity provided by breath inflation (which permits only a very small rise above atmospheric pressure) is relatively low, but is sufficient for small load-bearing as it discussed in more detail below.

It is possible to use materials having less deformability (although still flexible), such as sheet plastic materials reinforced with fabric or plastic laminated or impregnated fabrics, such as are used in inflatable air mattresses boats, etc. Such materials attain a certain inflated dimension and then are strongly resistent to dimensional expansion beyond it, due to the tensile strength of the fibers. Thus, they may be inflated to higher pressures by mechanical means, and achieve greater ridigity. It is apparent that these distinctions in materials are not in themselves critical to the concept of the invention, but are matter of variation which permit the adaption of the system to various uses. The sheet materials, the air pumps, the sealing means, the valves, and the accepted range of pressures is well understood for other types of inflated sturctures and is applicable here.

Figure 4:
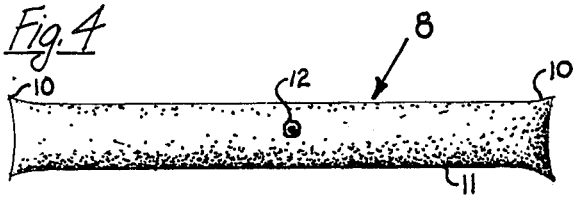
FIG. 4 is a plan view of a plain inflated element.
Figure 5:
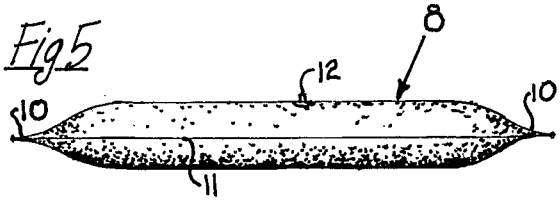
FIG. 5 is a side view of the plain inflated element of FIG. 4.

FIGS. 4 and 5 are respectively a plan view and side view of a plain inflated element 8 in this element, the entire length is a generally circular cross-section generally cylindrical portion 11. One way of looking at it is as if the plain element 8 is the main portion 2 of the previously described element without the loops. A seal 11 runs around the entire periphery of two identically matched elongated rectangular flat pieces of sheet material, which are heat sealed, all as has been described above. Note that the corners 10 of element 8 extend into points. The pieces are die cut into simple rectangles with right-angle corners. When the element 8 is inflated, the pointed corner structure appears. This is a useful characteristic, as is explained below in connection with various interconnections.

Figure 6:
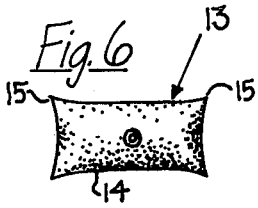
FIG. 6 is a plan view of a short plain inflated element or plug.

FIG. 6 is a plan view of a short inflated element which may also be called a plug or a plug joiner generally designated 13. It comprises a generally cylindrical portion 14 and has the pointed corners 15. The description made above in connection with FIGS. 4 and 5 applies with respect to FIG. 6 also, the only difference being that the length to width ratio of plus 13 is smaller than is the case in either the plain inflated element 8 or the loop inflated element 1.

This invention achieves its important usefulness when there are a plurality of inflated elements involved in an assembly or suitable for assembly. The plurality of elements may be either looped or plain or plugs, and may have different lengths. For maximum usefullness however, the transverse diameters of the main portions 2, or the cylindrical portion 11 or 14 as the case may be should be the same. In addition, the inner and outer diameters of loops of the various elements among the plurality of elements should be the same. It is these dimensions which permit universal interconnection.

Figure 7:
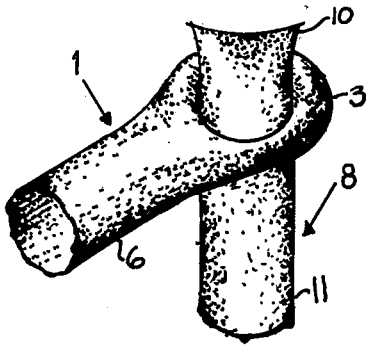
FIG. 7 is a perspective view, partially fragmented, showing an interconnection between a plain inflated element and a looped inflated element.
Figure 8:
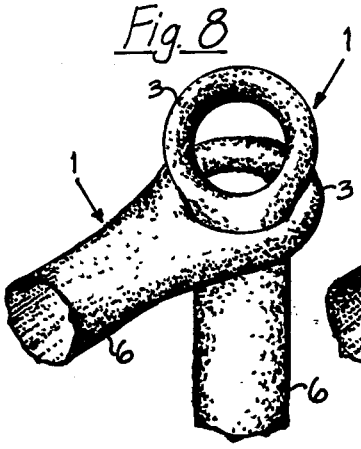
FIG. 8 is a perspective view, partially fragmented, showing the interconnection between two looped inflated elements.
Figure 9:
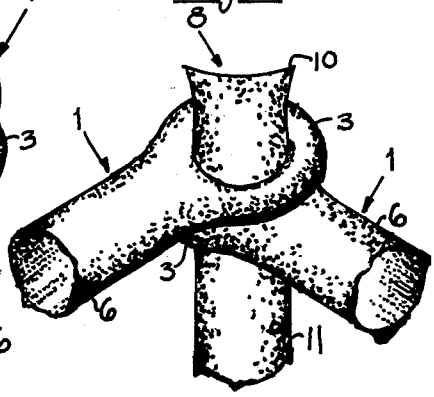
FIG. 9 is a perspective view, partially fragmented, showing the interconnection between a plain inflated element and two looped inflated elements, with the plain inflated element forming a "post", and each of the two looped elements extending out from it at right angles, and at an angle to each other.

FIGS. 7, 8 and 9 illustrate some fundamental ways of making basic connections between the inflated elements. In FIG. 7, there is shown, fragmented one end of a looped inflated element 1, interconnected with one end shown fragmented, of a plain inflated element 8. Each elements has been inflated until it is still and self-supporting. Nevertheless, with such inflatable devices, there is always available some give and deformation. Therefore, it is possible to insert the end of plain element 8 through the opening made by loop 3 in the end of element 1. It will be recalled that it is preferrable to have the opening made by these loops 3 of a diameter slightly smaller than the transverse diameter of the main portion 2, and it is also recalled that the transverse diameters of the main or cylindrical portions of all the plurality of elements should be the same. Thus, in the connection shown in FIG. 7, the preferred transverse diameter of the cylindrical portion 11 is slightly larger than the opening defined by loop 3. The exact dimensional relationship is not critical; the dimensional relationships indicated in the specific dimensional examples above have been found to be suitable and preferrable. It is apparent that if the diameter of cylindrical portion 11 is too much greater than that of the hole, it will be difficult or impossible to push element 8 into the hole. On the other hand, if the diameter of portion 11 is smaller than that of the hole, it will be easy to insert, but will make a loose fit and can fall out easily, so it is not preferrable and exact equality of hole diameter and cylindrical portion diameter would work, but has been found to be a little looser in fit than is preferrable. By making the cylindrical portion a little larger than the hole, advantage is taken of the elastic properties of both elements, and assembly and disassembly are permitted, but there is also a snug firm fit which aid structural integrity. The advantage of the pointed corners 10 may also be seen from FIG. 7. These points, which in effect increase the diameter of the plain element 8 at the extreme end, serve to provide an additional retaining or locking function which helps to prevent the elements from coming apart when not desired.

FIG. 8 illustrates the interconnection between two loop inflated elements 1. In this assembly, the loop 3 of one of the elements is forced through the hole in another element. As has been described above, the overall outer diameter of a loop 3 is substantially larger than the diameter of a hole 4, but it has been found to be easy by hand pressure to crush or collapse a loop 3 and insert it into a corresponding hole 4. The relationship between the transverse diameter of the main portion of a loop element to the hole 4 has been described and this aids in a firm fit. In addition, the larger overall outer diameter of the loop 3 compared to the diameter of the hole provides a substantial additional retaining or locking function to held prevent accidental disassembly of the elements when not desired.

FIG. 9 illustrates an assembly of two different looped inflated elements 1 onto one plain inflated element 8. This assembly may be made by first carrying out the steps as described in connection with FIG. 7 to make an assembly as shown in FIG. 7. Then, the identical steps are repeated with another loop element, resulting in the stack of looped elements each connected to a single plain element 8, as shown in FIG. 9.

It is apparent that in each of the fundamental connections shown in FIGS. 7, 8, and 9 one element extends from the other at right angles. In the compound embodiment shown in FIG. 9, while each looped element 1 extends at right angles from the plain element 8, the angular displacement with respect to each other of the looped elements 1 can be any angle.

In the joint or basic assembly illustrated in FIG. 9 for example, the plug joiner 13 may be substituted for the plain element 8. In such an assembly, the top portion of FIG. 9 would look the same, but the bottom, instead of ending in a fragmented portion of cylindrical portion 11 would end immediately below the joint with a structure identical to that shown above the joint in FIG. 9. It is apparent that a plug can be inserted into any loop. In the assembly just described, the plug 13 serves as a simple joining means in a manner analogous to a rivet.

It is apparent that a number of variations on the basic elements appear obvious. For example, an element can be looped at one end only. Another example is that a short element or plug or can be provided with loops at one or two ends. However, a large measure of the merit of this devlopment lies in the concept of a plurality of elements which have a near-universal interchangability. It has been found that keeping the types of elements to a low number increases the versatility of the system. There is an advantage in having elements of varying classes of length in providing versatility in the types of structures to be built. It is recognized that it is possible to confine the elements solely to looped elements. Most or not all of the many structures that have been built and tested could be made entirely with looped elements. The principal disadvantage to providing all looped elements is an asesthetic one, in that in many structures, there would be a profusion of unused loops.

Figure 10:
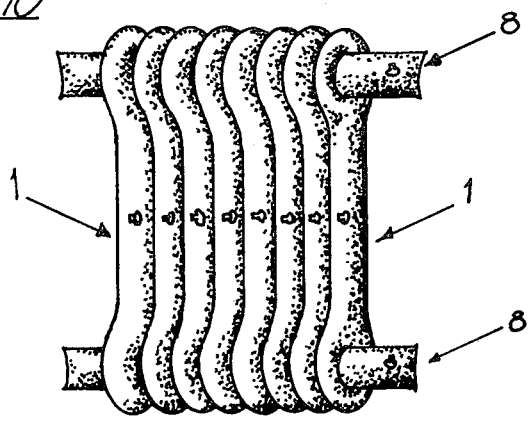
FIG. 10 is a perspective view, taken generally from the front right, showing a vertical wall made by the assembly of a plurality of vertical looped inflated elements connected at each end thereof to a plain inflated element.
Figure 11:
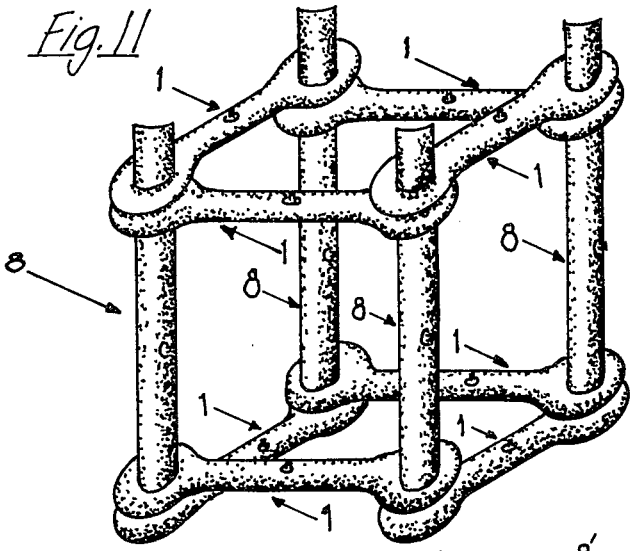
FIG. 11 is a perspective view, taken generally from the front right, and above, showing a six-sided box-like structure assembled from a plurality of horizontally disposed looped inflated elements and a plurality of vertically disposed plain inflated elements.
Figure 12:
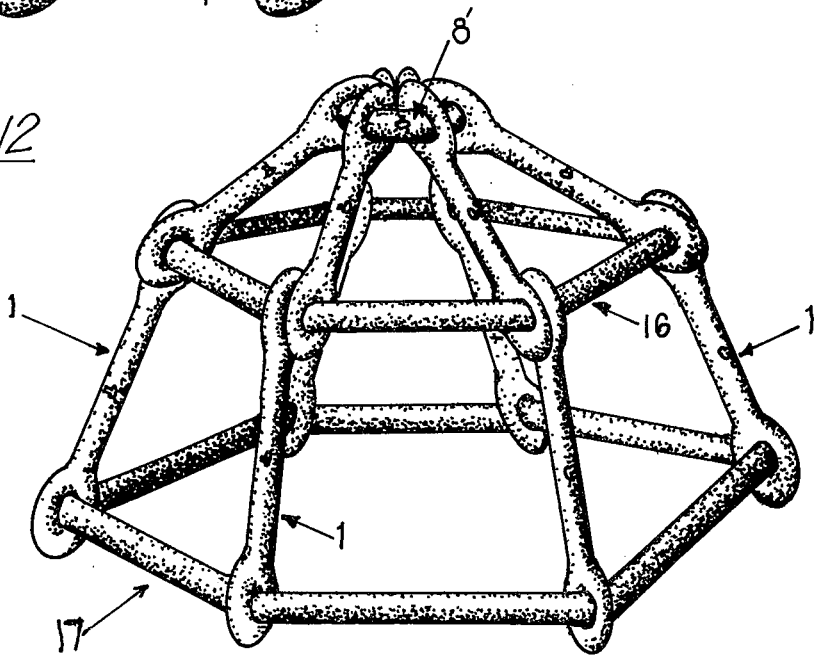
FIG. 12 is a perspective view taken generally from the front and above, showing a compound structure having pyramidal and dome-like qualities, assembled from a plurality of looped and plain inflated elements.

FIGS. 10, 11 and 12 are examples of structures which can be assembled from the elements described above. FIG. 10 may be described as a wall, although more broadly it is a plane surface which can have any desired orientation. A plurality of looped inflated elements 1 are provided with their holes aligned and in correspondence. A plain inflated element 8 is inserted entirely through each set of holes, and the plurality of looped elements 1 are pressed together into close proximity. The result is the plane surface as illustrated in FIG. 10. There are a number of ways in which that plane surface could be erected and held vertically, by using more elements. For example, additional looped elements could be attached to the lower plain inflated element 8, respectively to the right and left of the area of the wall, and these additional elements could be extended horizontally, that is, at right angles to the plane of the wall) to form a supporting base. A number of other arrangements are possible and will suggest themselves if it would be desired to have a vertical wall as shown in FIG. 10. The great variety of ways in which these elements could be assembled to form such structures, are not in themselves individually relied on to confer patentability, instead, the fact that this set or plurality of elements lends itself to such ingeneous arrangements is an important contribution to patentability. Another way to erect the wall of FIG. 10 vertically, would be to use longer looped elements 1, and attach pairs of them at each side of the wall to the upper plain inflated element 8, and have them extend outwardly and downwardly at, say, a 45° angle to be vertical to provide a triangular prop, from which the wall is hung. These are only examples, and they can be multiplied.

FIG. 11 shows a six-sided box like structure. Four vertical corner posts are each plain inflated structures 8. Four looped structures 1 are arranged at the bottom ends of the posts, to form a rectangular base as shown. They are forced over the ends of the respective plain elements 8, as has been described. Four more looped elements 1 are similarly provided at the top ends of the posts, so as to complete the box-like structure.

FIG. 12 shows a more complex compound structure having pyramidal and dome-like qualities. Six plain inflated elements are arranged to form a hexagonal base generally designated as 17. Six looped elements 1 are interconnected to the base. Each looped element extends generally upwards and vertically and although slanting inwardly somewhat from the true vertical. The bottom loop of each looped element 1 interconnects with the ends of two adjacent ones of the plain elements which form the hexagonal base. In this case, to form the joint, two different ends of two plain elements are forced into the same bottom hole of a looped element. If it is found difficult to force the second plain element end into the hole, there is a technique available to make it easier. The plain elements are wholly or partially deflated, and they are inserted into the hole in a relatively limp condition, so that they can be crushed to a much smaller dimension. The insertion is quite easy. Then, they are inflated, or reinflated to full pressure, and a firm joint is thus provided. In FIG. 12, the drawing is made so that the ends of each of the horizontally disposed plain elements happen to be hidden behind other parts so that the ends themselves are not seen.

After assembling the first tier to the hexagonal base in FIG. 12, a second or intermediate base, also hexagonal 16 is provided using six plain inflated elements, each of which has a shorter length than those used in constructing the base 17. Each of these elements is assembled to the upper loop of the first tier of looped elements in the same manner as has been described. In addition, a second tire of looped elements is constructed, by providing six more looped elements, each one of which has its bottom loop interconnected adjacent the top loop of the first tier of looped elements.

Finally the top loops of each element of the second tier are connection. Another variant of the assembly is illustrated at this topmost joint in FIG. 12. A plain inflated element is bent to form a curved plain inflated element 8′ when a plain element is not fully inflated, it may be roughly bent and curved. Of course, a number of wrinkles are formed, and the overall curve may better be described as a series of short straight segments. Nevertheless, a plain inflated element can be bent back upon itself to form a generally closed curve 8′ as shown. Then, after having been inserted through all the top loops of the second tier of looped elements, the curved inflated element 8′ may be inflated or reinflated as desired to impart more rigidity.

Yet another variant on the structure as shown in FIG. 12 may be used to contribute to stability. It is possible to fill the entire hexagonal base with a liquid such as water. To do this efficiently, each of the elements used for the base 17 should preferrably be provided with two valves, one to admit water and the other to vent air. It is apparent that this would weight the entire structure. However, this is a type of refinement, which though possible, adds a degree of complexity both in structure (preferrably requiring two valves) and additional steps in erecting (the filling with water) that makes it to be considered a non-preferrable and usually unnecessary variation. It is mention primarily to show the flexibility of the entire system.

It is apparent that assemblies may be made having closed surfaces, as illustrated in FIG. 10, or open-work areas as shown in FIGS. 11 and 12. These two general types of areas or surfaces may be either made into two or three dimensional structures. They may be cubes or rectangular or boxes of other geometrical shapes. They may simulate houses or cabins or towers or tents. Geodesic domes may be constructed as may be arches, cylindrical tanks (silo shapes), pyramids and te pees. It is possible to erect fences, walls, room dividers, floor and ceiling structures, and also such elements as rafts and mattresses. Domes and trusses may be constructed. Purely decorative structures, such as are known as stabiles and mobiles may be constructed. For example, a single long vertical plane element may be erected, and a plurality of relatively shorter looped elements may be successively stacked along it, angularly equally displaced from each other, so as to form a suggested spiral staircase.

For broader functional purpose, it is apparent that the system provides an interesting toy, in that a safe, light, easily handled structure of relatively very large dimensions may be erected by children. In addition to simulating other structures as has been described, sculptural shapes such as animals may be constructed. Another important avenue is for the construction of utilitarian lightweight structures, as are useful to campers. Thus, lightweight portable compact leantos and shelters may be easily carried and erected by inflation and assembly. Certain types of furniture may be constructed. Another important field of use is in the erection of displays that are intended to be temporary. Thus, a department store or similar institution can keep a plurality of relatively large elements in compact storage, and can then erect displays for use in open areas or in windows having abstract or other decorative qualities. These can have enough structural property to display clothing or other items, for example, and when the display is finished, the elements can be deflated and stored away.

The term "inflated" is apt in describing the elements and is intended to have a broad meaning and construction. When made, shipped and stored, the elements might be said to be "inflatable"rather than "inflated", but the term "inflated"is meant to include this condition of the element. For the purposes of this patent, the distinction between "inflated" and "inflatable" is not critical to the concept, and the terms may be used interchangeably.

We claim:

1. A structure formed by at least a pair of inflated, hollow, elongated elements of impermeable flexible closed contour sheet material, comprising a valve on each of said elements, each of said elements having a main portion forming a generally cylindrical shape in the elongated direction, said elements having completely closed continuous loops at each extreme end of said main portion, said loops defining and enclosing a hole of continuous unbroken circumference, each of said holes having a diameter equal to approximately the greatest transverse diameter of said main portion of a corresponding element, each of said loops having an outer diameter greater than said transverse diameter of said main portion of said corresponding element, and each of said hole circumferences having the same configuration as said element main portion on a plane along said transverse diameter, said elements joined each to the other to form said structure whereby one of said loops of one element is deformed to pass through said hole of another of said inflated elements and expanded to lockingly engage said elements in a releasable manner each to the other.

2. The structure formed by at least a pair of inflated, hollow, elongated elements of impermeable flexible closed contour sheet material as recited in claim 1, wherein each said loop has a largest overall outer diameter greater than the largest transverse diameter of said main portion, and each said loop has a thickness at right angles to the plane of said overall diameter, said thickness being less than the greatest transverse diameter of said main portion.

3. The structure formed by at least a pair of inflated, hollow, elongated elements of impermeable flexible closed contour sheet material as recited in claim 2, wherein said loops are also sealed together around the edges of each of said holes.

4. The structure formed by at least a pair of inflated, hollow, elongated elements of impermeable flexible closed contour sheet material as recited in claim 1, wherein at least one loop of said inflated element is inserted completely through one hole in another of said inflated elements to form a joint between said two elements.

5. The structure formed by at least a pair of inflated, hollow, elongated elements of impermeable flexible closed contour sheet material as recited in claim 1, combined with a plain inflated element, said plain inflated element being generally cylindrical, elongated, hollow of impermeable flexible sheet material, and including a valve, and having pointed corners at its ends, one of said ends of said plain elongated inflated element being inserted completely through said hole in one of said inflated elements including a loop, to form a joint between said plain and said looped inflated elements.

6. The combination set forth in claim 5 wherein an additional said looped inflated element is provided and said end of said plain inflated element is inserted additionally through one hole in said additional looped inflated element, to form a three element joint.

* * * * *